US011699873B2

(12) United States Patent
Yagi et al.

(10) Patent No.: US 11,699,873 B2
(45) Date of Patent: Jul. 11, 2023

(54) METHOD FOR PRODUCING SHIELD WIRE, SHIELD WIRE WITH EARTHING MEMBER, AND CLAMPING DEVICE

(71) Applicant: Yazaki Corporation, Tokyo (JP)

(72) Inventors: Shintaro Yagi, Kakegawa (JP); Shin Kono, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 39 days.

(21) Appl. No.: 17/486,132

(22) Filed: Sep. 27, 2021

(65) Prior Publication Data

US 2022/0102909 A1 Mar. 31, 2022

(30) Foreign Application Priority Data

Sep. 28, 2020 (JP) ..... 2020-162413

(51) Int. Cl.

| | |
|---|---|
| ***H01R 13/58*** | (2006.01) |
| ***H01R 13/655*** | (2006.01) |
| ***H01R 13/6581*** | (2011.01) |
| *H01B 5/12* | (2006.01) |

(52) U.S. Cl.

CPC ..... *H01R 13/582* (2013.01); *H01R 13/655* (2013.01); *H01R 13/6581* (2013.01); *H01B 5/12* (2013.01)

(58) Field of Classification Search

CPC ..... H01R 13/582; H01R 13/655; H01R 13/6581; H01B 5/12

USPC ..... 439/578

See application file for complete search history.

(56) References Cited

U.S. PATENT DOCUMENTS

| | | | | |
|---|---|---|---|---|
| 6,438,823 | B2 * | 8/2002 | Yamakawa | H01R 43/058 29/748 |
| 6,568,075 | B1 * | 5/2003 | Yamakawa | H01R 43/058 29/748 |
| 8,827,744 | B2 * | 9/2014 | Poma | H01R 4/20 439/585 |
| 10,177,517 | B1 * | 1/2019 | Lewis | B21D 15/02 |
| 10,355,379 | B1 * | 7/2019 | Lewis | H01R 4/20 |
| 10,361,496 | B1 * | 7/2019 | Weiland | H01R 43/058 |
| 10,615,558 | B2 * | 4/2020 | Malloy | H01R 43/0585 |

(Continued)

FOREIGN PATENT DOCUMENTS

| | | | | |
|---|---|---|---|---|
| DE | 102017215948 | A1 * | 3/2018 | B60R 16/0215 |
| JP | 2000021543 | A * | 1/2000 | H01R 43/058 |

(Continued)

*Primary Examiner* — Peter G Leigh

(74) *Attorney, Agent, or Firm* — Sughrue Mion, PLLC

(57) ABSTRACT

A method for producing a shield wire includes: disposing the first terminal at an opening end portion of the shield body in a state where the covered wire and the shield body are inserted into the first terminal; folding the opening end portion of the shield body to an outer side and disposing the second terminal to sandwich the folded opening end portion; and press-deforming the first terminal and the second terminal into a clamping shape. A mold surface of the mold has a protruding portion protruding toward the axis, and a protruding end surface of the protruding portion has a radius of curvature smaller than a radius of an outer peripheral surface of the second terminal before clamping and larger than a radius of an outer peripheral surface of the covered wire before clamping.

2 Claims, 6 Drawing Sheets

(56) References Cited

U.S. PATENT DOCUMENTS

| | | | | |
|---|---|---|---|---|
| 2001/0002508 | A1* | 6/2001 | Yamakawa | H01R 43/058 72/409.14 |
| 2019/0279884 | A1 | 9/2019 | Yamashita et al. | |
| 2019/0356101 | A1 | 11/2019 | Masuda et al. | |

FOREIGN PATENT DOCUMENTS

| | | | | | |
|---|---|---|---|---|---|
| JP | 2009117286 | A | * | 5/2009 | |
| JP | 2010160957 | A | * | 7/2010 | H01R 9/0518 |
| JP | 2013236429 | A | * | 11/2013 | H01R 13/6591 |
| JP | 2017147419 | A | * | 8/2017 | |
| JP | 2019003842 | A | | 1/2019 | |
| JP | 2019160957 | A | | 9/2019 | |
| JP | 2019-204599 | A | | 11/2019 | |
| WO | WO-2011102536 | A1 | * | 8/2011 | H01R 4/183 |
| WO | WO-2013168818 | A1 | * | 11/2013 | H01R 13/6591 |
| WO | WO-2017159751 | A1 | * | 9/2017 | H01B 7/18 |

* cited by examiner

METHOD FOR PRODUCING SHIELD WIRE, SHIELD WIRE WITH EARTHING MEMBER, AND CLAMPING DEVICE

CROSS-REFERENCE TO RELATED APPLICATIONS

This application is based on and claims priority under 35 USC 119 from Japanese Patent Application No. 2020-162413 filed on Sep. 28, 2020, the contents of which are incorporated herein by reference.

TECHNICAL FIELD

The present invention relates to a method for producing a shield wire with an earthing member, a shield wire with an earthing member, and a damping device that can be used for producing such a shield wire.

BACKGROUND ART

In related art, a method has been proposed in which a tubular clamping member is clamped and fixed to an outer periphery of a predetermined object. For example, one of clamping devices of related art (hereinafter referred to as a "device of related art") is configured to clamp and fix a tubular earthing metal fitting for grounding a braided conductor to a shield wire including a covered wire and a braided conductor (tubular body obtained by braiding a copper wire or the like) that covers the covered wire.

As for details of the above clamping device, refer to JP 2019-003842 A and JP 2019-160957 A.

Incidentally, when the earthing metal fitting is clamped and fixed to the shield wire as described above, in order to prevent the positional deviation or the like of the earthing metal fitting, a press-bonded point (dent in appearance) at which the earthing metal fitting bites into the braided conductor is formed by a protruding portion protruding in a hemispherical shape from a mold surface of a clamping mold (see, for example, JP 2019-160957 A). As the dent deeply bites into the braided conductor or the covered wire, the earthing metal fitting is firmly fixed, but a stress generated at a position where the dent bites into the braided conductor or the covered wire inevitably increases. When the stress venerated at the position is excessively large, a load on the braided conductor or the covered wire becomes large, and there is a possibility that the braided conductor or the covered wire is damaged or the like. On the other hand, when the bite of the dent is shallow and insufficient, a sufficient holding force for fixing the earthing metal fitting to the braided conductor or the covered wire cannot be obtained, and there is a possibility that positional deviation or the like of the earthing metal fitting occurs. In this way, it is generally difficult to achieve both the improvement of the holding force of the earthing metal fitting and the reduction of the load on the shield wire.

SUMMARY OF INVENTION

Aspect of non-limiting embodiments of the present disclosure relates to provide a method for producing a shield wire, a shield wire with an earthing member, and a clamping device, which can achieve both increase in a holding force for fixing an earthing member to a covered wire and reduction in a load on the shield wire.

Aspects of certain non-limiting embodiments of the present disclosure address the features discussed above and/or other features not described above. However, aspects of the non-limiting embodiments are not required to address the above features, and aspects of the non-limiting embodiments of the present disclosure may not address features described above.

According to an aspect of the present disclosure, there is provided a method for producing a shield wire which is a production method for producing a shield wire including a covered wire configured to cover a conductor core wire with a covering layer, a tubular shield body disposed to cover the conductor core wire, and an earthing member clamped and fixed to the shield body, the earthing member including a tubular first terminal and a tubular second terminal, and the production method comprising:

disposing the first terminal at an opening end portion of the shield body in a state where the covered wire and the shield body are inserted into the first terminal;

folding the opening end portion of the shield body to an outer side in a radial direction and disposing the second terminal so as to sandwich the folded opening end portion between an outer peripheral surface of the first terminal and an inner peripheral surface of the second terminal; and press-deforming the first terminal and the second terminal into a damping shape by sandwiching the first terminal and the second terminal with a mold in a direction intersecting an axis of the covered wire, wherein a mold surface of the mold includes a protruding portion protruding toward the axis, and a protruding end surface of the protruding portion has a radius of curvature smaller than a radius of an outer peripheral surface of the second terminal before clamping and larger than a radius of an outer peripheral surface of the covered wire before clamping.

According to another aspect of the present disclosure, there is provided a shield wire with an earthing member comprising:

a covered wire configured to cover a conductor core wire with a covering layer;

a tubular shield body disposed to cover the conductor core wire; and an earthing member clamped and fixed to the shield body, wherein the earthing member includes a tubular first terminal and a tubular second terminal, the shield wire has a clamping shape in which the covered wire and the shield body are inserted into the first terminal, an opening end portion of the shield body is folded to an outer side in a radial direction, the folded opening end portion is sandwiched between an outer peripheral surface of the first terminal and an inner peripheral surface of the second terminal, and the first terminal and the second terminal are clamped so as to have a groove-shaped portion recessed toward an axis of the covered wire, and the groove-shaped portion has a groove bottom surface extending in a circumferential direction of the covered wire and a groove side surface extending to an outer side in a radial direction of the covered wire from both ends of the groove bottom surface in the circumferential direction.

According to still another aspect of the present disclosure, there is provided a clamping device that clamps and fixes a tubular clamping member to an outer periphery of a predetermined object, the clamping device comprising:

a mold configured to press-deform the clamping member by sandwiching the clamping member in a direction intersecting an axis thereof, wherein a mold surface of the mold includes a protruding portion protruding toward the axis, and the protruding portion has a protruding end surface extending in a circumferential direction of the damping member, and a protruding side surface extending to an outside of the clamping member in a radial direction from both ends of the protruding end surface in the circumferential direction.

BRIEF DESCRIPTION OF DRAWINGS

Embodied embodiment(s) of the present invention described in detail based on the following figures, wherein.

DESCRIPTION OF EMBODIMENTS

Hereinafter, a clamping device according to an embodiment of the present invention, a method for producing a shield wire according to an embodiment of the present invention using the clamping device, and a shield wire produced in this manner will be described with reference to the drawings.

Figure 1:
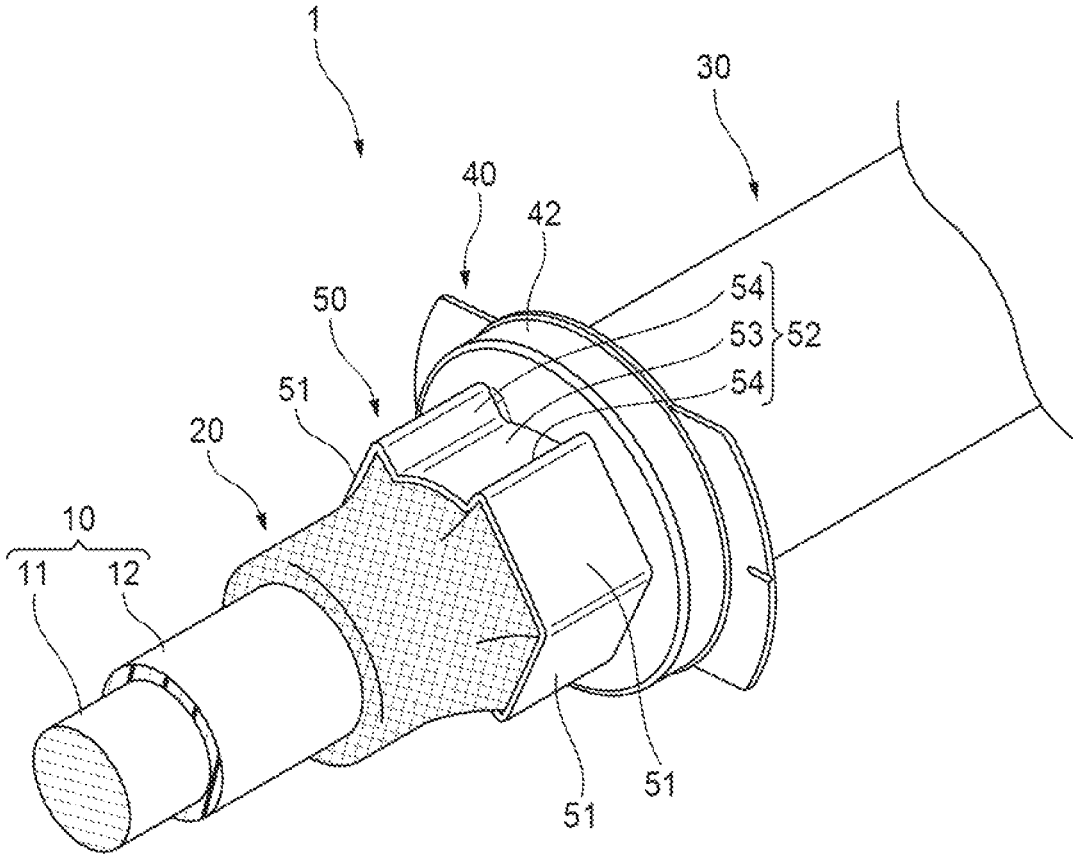
FIG. 1 is a schematic perspective view of a shield wire with an earthing member according to an embodiment of the present invention.

FIG. 1 shows a shield wire 1 with an earthing member. Specifically, the shield wire 1 includes a covered wire 10 (a core wire 11 and a tubular insulating covering layer 12 that covers an outer periphery of the core wire 11), a tubular braided conductor 20 that covers an outer periphery of the covered wire 10, and a tubular sheath (insulating sheath) 30 that covers an outer periphery of the braided conductor 20. An earthing member (a shield terminal 40 and a clamping ring 50) is clamped and fixed to the braided conductor 20 of the shield wire 1, whereby the shield wire 1 with an earthing member shown in FIG. 1 is produced. The shield terminal 40 functions as a grounding member for releasing electromagnetic noise collected by the braided conductor 20 to a ground object.

In the present example, the shield wire 1 includes the sheath 30 that covers the outer periphery of the braided conductor 20, but the sheath 30 may be omitted and the braided conductor 20 may be formed as a separate body from the covered wire 10 so as to be exposed to the outside. Hereinafter, for convenience of description, an axis (axis direction), a radial direction, and a circumferential direction of the shield wire 1 may be simply referred to as an "axis (axis direction)", a "radial direction", and a "circumferential direction", respectively.

The shield terminal 40 is a metal cylindrical body having a cylindrical portion 41 having a cylindrical shape and a flange portion 42 expanding to an outer side of the cylindrical portion 41 in the radial direction from a rear end portion before clamping (see FIG. 2A), and is disposed in the vicinity of an opening end portion 21 of the braided conductor 20. The opening end portion 21 of the braided conductor 20 is folded so as to cover the cylindrical portion 41 of the shield terminal 40.

Figure 2A:
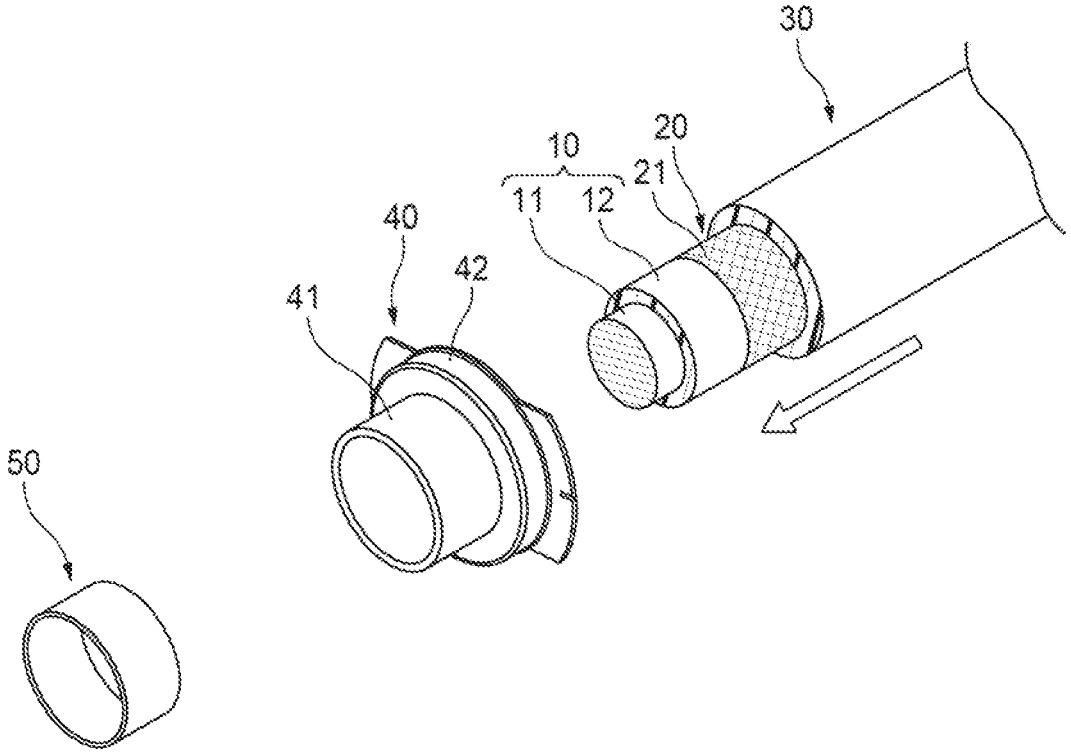
FIG. 2A and FIG. 2B are a first view for illustrating a producing process of the shield wire shown in FIG. 1.

The clamping ring 50 is a metal cylindrical body having a cylindrical shape before clamping (see FIG. 2A). The clamping ring 50 is clamped and fixed to the outer periphery of the opening end portion 21 of the folded braided conductor 20 by being press-deformed into a clamping shape by a clamping device 2 (see FIG. 5) described later.

Figure 6A:
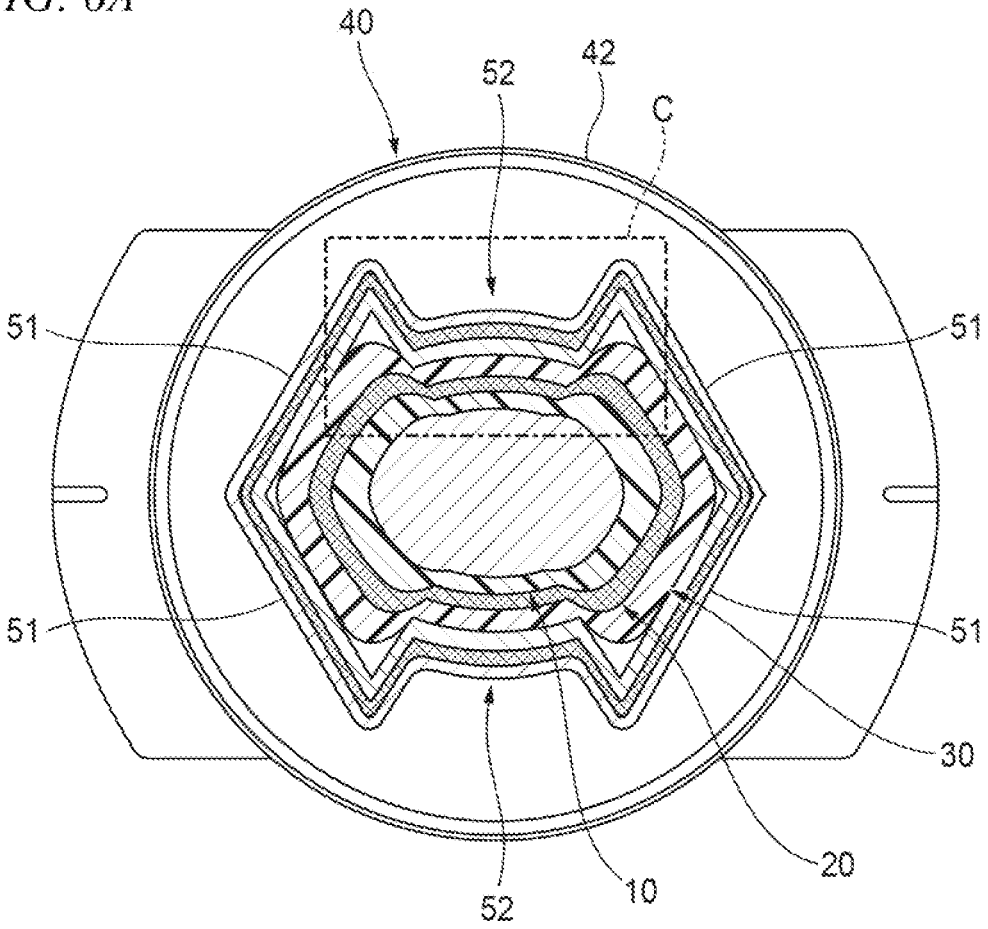
FIG. 6A is a cross-sectional view taken along a line B-B in FIG. 4B.
Figure 6B:
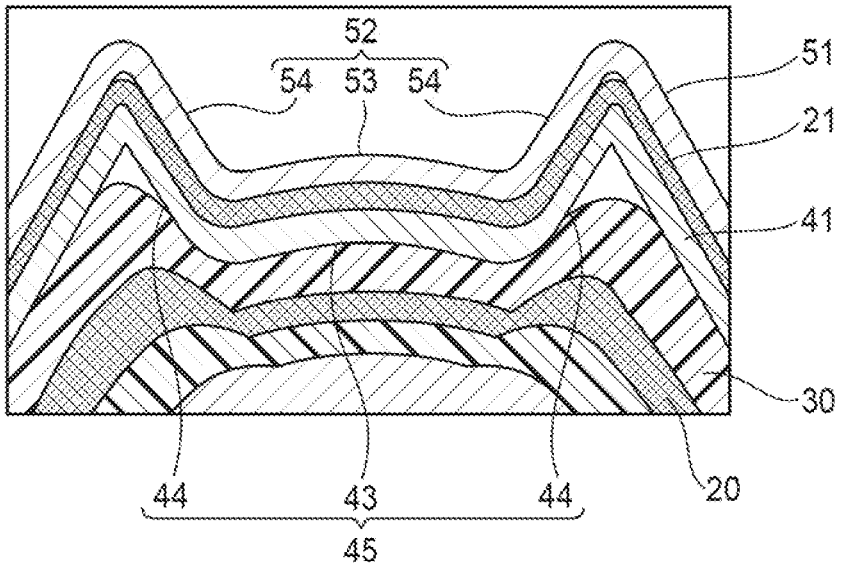
FIG. 6B is an enlarged view of a portion C in FIG. 6A.

As shown in FIGS. 1 and 6, the clamping shape of the clamping ring 50 is a shape in which a groove-shaped portion 52 is formed instead of a flat surface 51 only for each of a pair of flat surfaces 51 facing each other in a vertical direction in a regular hexagonal cylindrical shape having six flat surfaces 51 on the outer periphery. The groove-shaped portion 52 is recessed toward the axis and extends over the entire region in the axis direction, and includes a groove bottom surface 53 extending in the circumferential direction in an arc shape in cross section, and groove side surfaces 54 extending to an outer side in the radial direction from both ends of the groove bottom surface 53 in the circumferential direction.

When the clamping ring 50 is press-deformed into the clamping shape described above, the cylindrical portion 41 of the shield terminal 40 located on an inner side of the clamping ring 50 in the radial direction is also press-deformed into a clamping shape corresponding to the clamping shape of the clamping ring 50. As a result, also in the clamping shape of the cylindrical portion 41 of the shield terminal 40, a pair of upper and lower groove-shaped portions 45 are formed corresponding to the pair of upper and lower groove-shaped portions 52 of the clamping ring 50 (see FIG. 6B).

Similarly to the groove-shaped portion 52 of the clamping ring 50, the groove-shaped portion 45 of the shield terminal 40 is recessed toward the axis and extends over the entire region in the axis direction, and includes a groove bottom surface 43 extending in the circumferential direction in an arc shape in cross section, and groove side surfaces 44 that extend to the outer side in the radial direction from both ends of the groove bottom surface 43 in the circumferential direction. The operation and effects of the clamping shapes of the clamping ring 50 and the shield terminal 40 having the groove-shaped portion 52 and the groove-shaped portion 45, respectively, will be described later.

Next, a method for producing the shield wire 1 shown in FIG. 1 will be described with reference to FIGS. 2 to 4.

First, as shown in FIG. 2A, the covered wire 10 having the braided conductor 20 and the sheath 30 provided on the outer periphery thereof, the shield terminal 40, and the clamping ring 50 are prepared. In the prepared covered wire 10, a predetermined terminal treatment is performed such that the opening end portion 21 of the braided conductor 20 to be folded later protrudes and is exposed from a tip end of the sheath 30 to a tip end side.

Figure 2B:
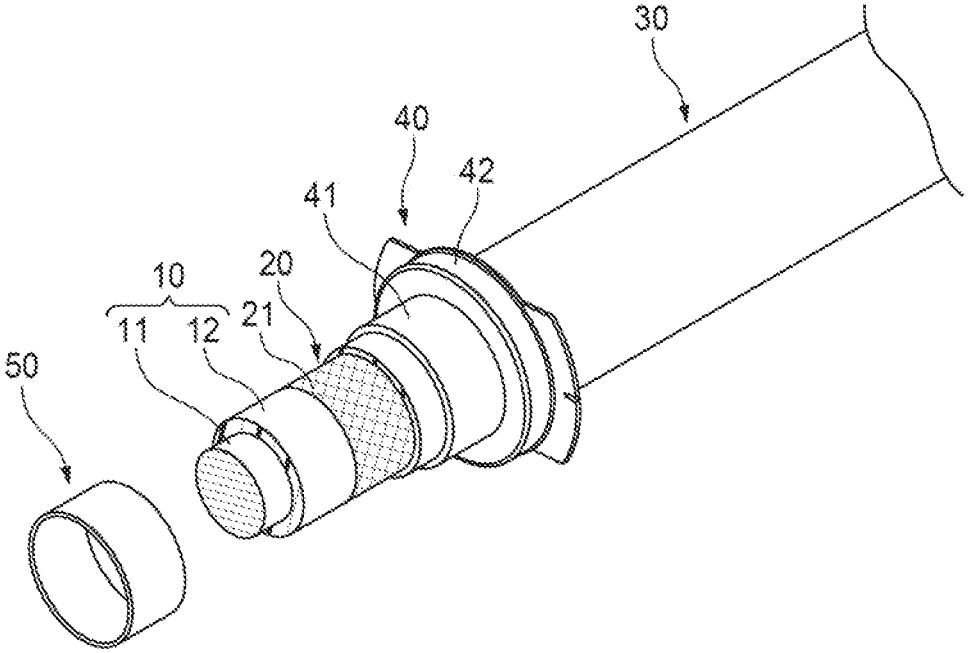
Figure 3A:
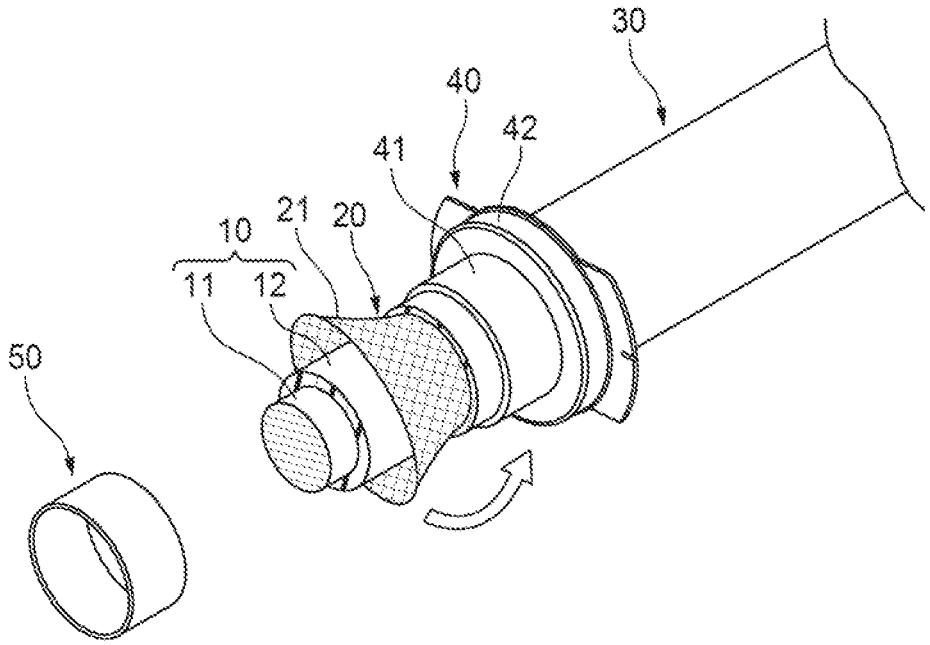
FIG. 3A and FIG. 3B are as second view for illustrating the producing process of the shield wire shown in FIG. 1.

Next, as shown in FIG. 2B, the shield terminal 40 is inserted and disposed in the vicinity of the opening end portion 21 of the braided conductor 20 (more specifically, in such a manner that a tip end portion of the cylindrical portion 41 of the shield terminal 40 is positioned slightly on a rear end side with respect to the tip end of the sheath 30). Next, as shown in FIG. 3A, the opening end portion 21 of the braided conductor 20 is diametrically expanded.

Figure 3B:
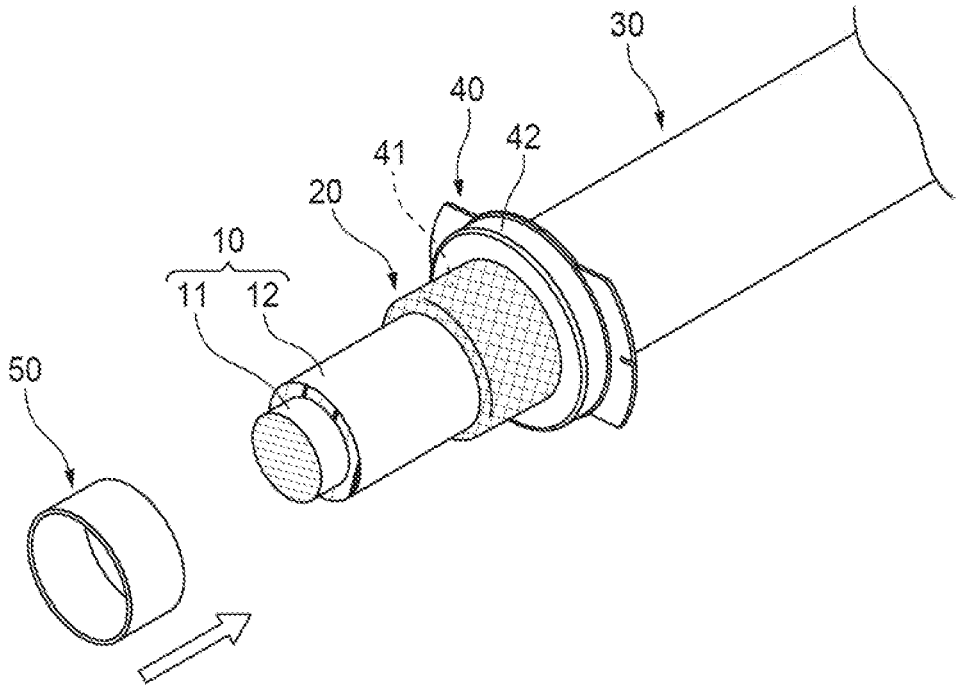

Next, as shown in FIG. 3B, the opening end portion 21 of the diametrically expanded braided conductor 20 is folded to the outer side in the radial direction (that is, so as to cover the outer peripheral surface of the cylindrical portion 41 of the shield terminal 40) with the tip end of the sheath 30 as a starting point. Thus, the opening end portion 21 of the braided conductor 20 is disposed on the outer periphery of the cylindrical portion 41 of the shield terminal 40 so as to cover the cylindrical portion 41 of the shield terminal 40.

Figure 4A:
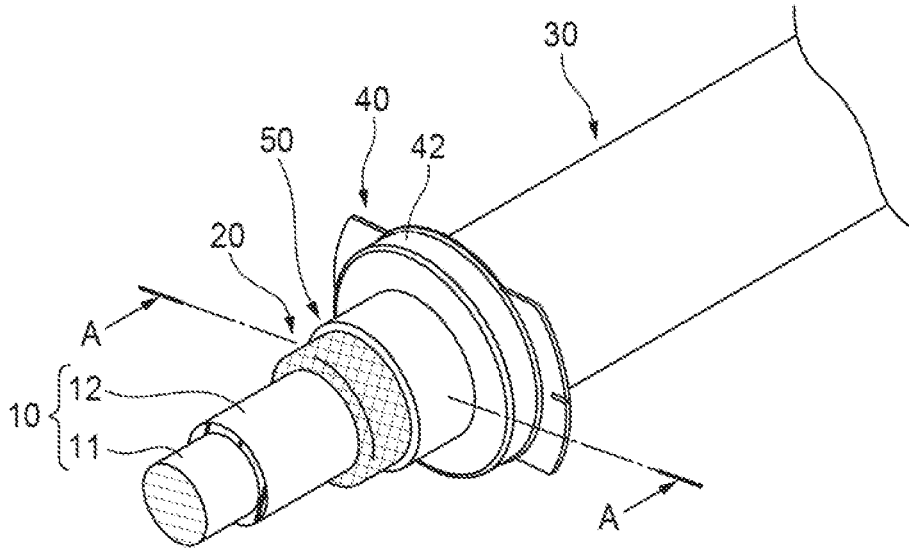
FIG. 4A and FIG. 4B are a third view for illustrating the producing process of the shield wire shown in FIG. 1.

Next, as shown in FIG. 4A, the clamping ring 50 is inserted and disposed on the outer periphery of the opening end portion 21 of the folded braided conductor 20. Thus, the folded opening end portion 21 is sandwiched between the outer peripheral surface of the cylindrical portion 41 of the shield terminal 40 and the inner peripheral surface of the clamping ring 50.

Figure 4B:
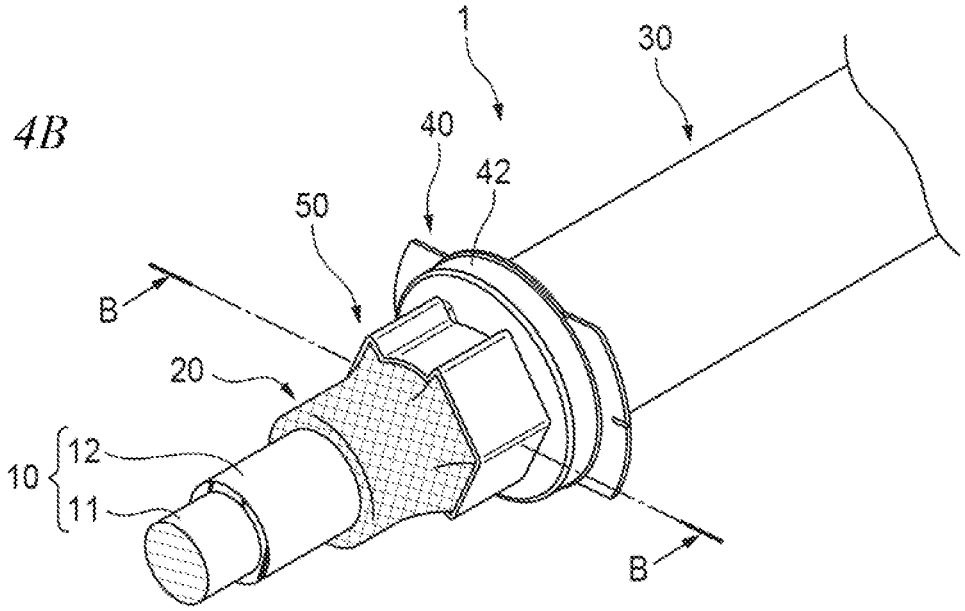

Next, as shown in FIG. 4B, the clamping ring 50 and the cylindrical portion 41 of the shield terminal 40 are each press-deformed into the clamping shape described above by the clamping device 2 (see FIG. 5), thereby being clamped and fixed to the outer periphery and the inner periphery of the opening end portion 21 of the folded braided conductor 20. As a result, the shield wire 1 is produced in which the shield terminal 40 is firmly fixed to and electrically coupled to the braided conductor 20.

<Clamping Device>

Next, the clamping device 2 according to the embodiment of the present invention used for producing the shield wire 1 will be described with reference to FIG. 5.

Figure 5:
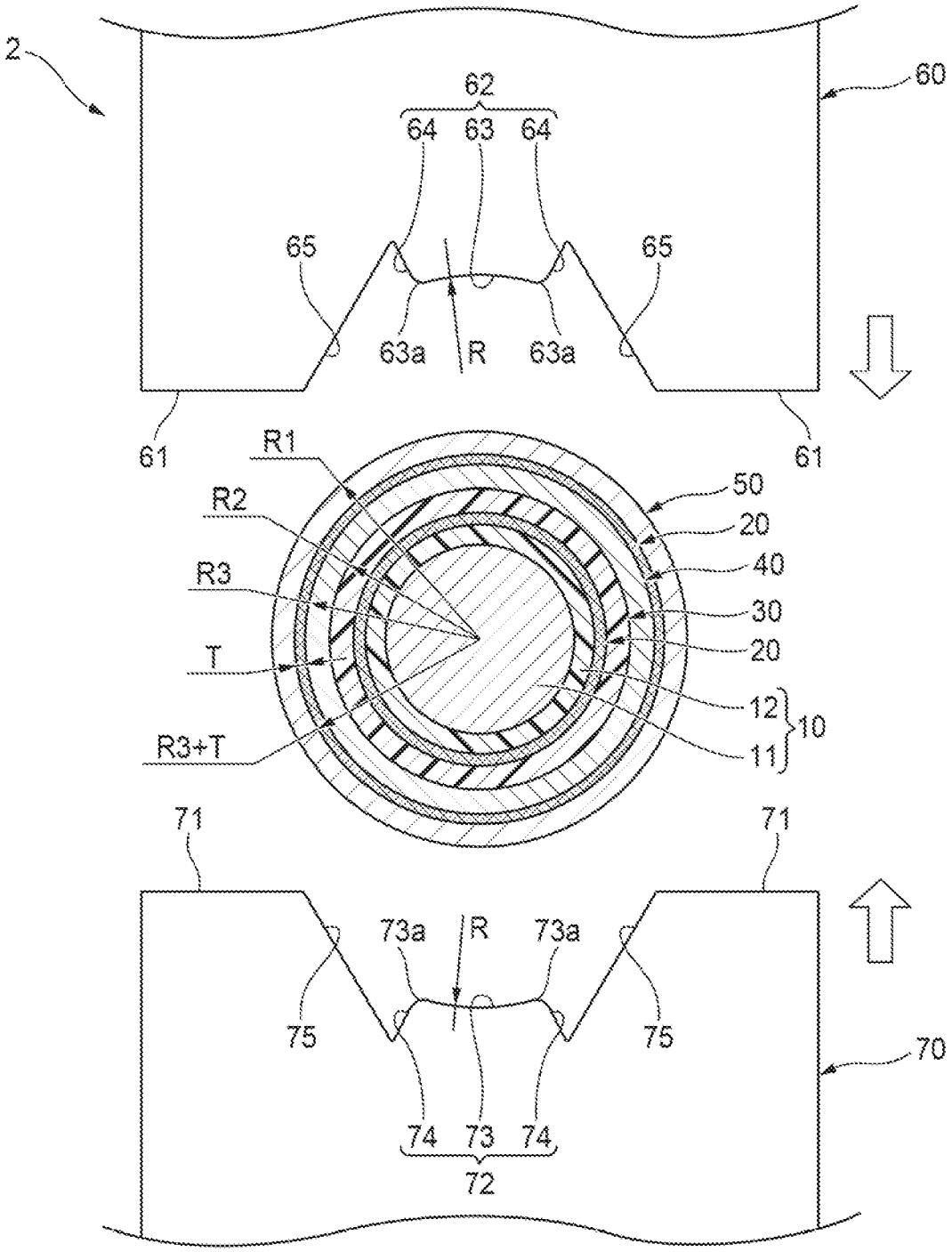
FIG. 5 is a cross-sectional view corresponding to an A-A cross section in FIG. 4A, showing a state before clamping a clamping ring of a shield wire using an upper die and a lower die provided in a clamping device according to the embodiment of the present invention.

As shown in FIG. 5, the clamping device 2 includes an upper die 60 and a lower die 70. The upper die 60 and the lower die 70 are disposed above and below the clamping ring 50 in the state shown in FIG. 4A, respectively.

Each of the mold surfaces of the upper die 60 and the lower die 70 has such a shape that when a mating surface 61 of the upper die 60 and a mating surface 71 of the lower die 70 are mated with each other, a cylindrical mold space corresponding to the clamping shape (see FIGS. 1 and 6) of the damping ring 50 is formed.

Specifically, the mold surface of the upper die 60 includes a protruding portion 62 corresponding to the upper groove-shaped portion 52 in the clamping shape of the clamping ring 50, and a pair of flat surface portions 65 corresponding to the pair of flat surfaces 51 adjacent to the upper groove-shaped portion 52 in the clamping shape of the clamping ring 50. The protruding portion 62 protrudes toward the axis and extends over the entire region in the axis direction, and includes a protruding end surface 63 extending in the circumferential direction in an arc shape in cross section, and protruding side surfaces 64 extending to the outer side in the radial direction from both ends of the protruding end surface 63 in the circumferential direction.

The mold surface of the lower die 70 includes a protruding portion 72 corresponding to the lower groove-shaped portion 52 in the clamping shape of the damping ring 50, and a pair of flat surface portions 75 corresponding to the pair of flat surfaces 51 adjacent to the lower groove-shaped portion 52 in the clamping shape of the clamping ring 50. The protruding portion 72 protrudes toward the axis and extends over the entire region in the axis direction, and includes a protruding end surface 73 extending in the circumferential direction in an arc shape in cross section, and protruding side surfaces 74 extending to the outer side in the radial direction from both ends of the protruding end surface 73 in the circumferential direction.

The radius of curvature of the protruding end surface 63 of the protruding portion 62 and the radius of curvature of the protruding end surface 73 of the protruding portion 72 have the same value, and the radius of curvature is defined as "R" (see FIG. 5). The radius of the outer peripheral surface of the clamping ring 50 before clamping is defined as "R1", the radius of the outer peripheral surface of the sheath 30 (that is, the shield wire 1) before clamping is defined as "R2", the radius of the outer peripheral surface of the cylindrical portion 41 of the shield terminal 40 before clamping is defined as "R3", and the thickness of the braided conductor 20 (the opening end portion 21) is defined as "T". At this time, a relationship of $R2<R<R1$ is established. Furthermore, a relationship of $R3+T\leq R$ is also established. R3+T means the radius of the outer peripheral surface of the opening end portion 21 of the folded braided conductor 20 before clamping.

As shown in FIG. 5, the upper die 60 and the lower die 70 described above are relatively brought close to each other in the vertical direction so as to sandwich the clamping ring 50, so that the clamping ring 50 and the cylindrical portion 41 of the shield terminal 40 are respectively press-deformed into the clamping shapes described above, and are clamped to the opening end portion 21 of the braided conductor 20, whereby the shield wire 1 shown in FIG. 1 is obtained.

When the clamping is performed by the upper die 60 and the lower die 70, the protruding portions 62, 72 press-deform the clamping ring 50 to the inner side in the radial direction. At this time, the radius of curvature R of the protruding end surfaces 63, 73 of the protruding portions 62, 72 is smaller than the radius R1 of the outer peripheral surface of the clamping ring 50 before clamping ($R<R1$). Accordingly, the protruding end surfaces 63, 73 of the protruding portions 62, 72 apply a local (linear) external force to the champing ring 50 at both end portions 63*a*, 73*a* (see FIG. 5) of the protruding end surfaces 63, 73. As a result, the clamping ring 50 and the cylindrical portion 41 of the shield terminal 40 can be firmly held and fixed to the braided conductor 20 while appropriately deforming the clamping ring 50 and the cylindrical portion 41 of the shield terminal 40 into a clamping shape having recessed groove-shaped portions 52, 45 (see FIG. 6B) corresponding to the protruding portions 62, 72, respectively.

On the other hand, the radius of curvature R of the protruding end surfaces 63, 73 of the protruding portions 62, 72 is larger than the radius R2 of the outer peripheral surface of the sheath 30 (shield wire 1) before clamping ($R2<R$), and is equal to or larger than the radius R3+T of the outer peripheral surface of the opening end portion 21 of the folded braided conductor 20 before clamping ($R3+T\leq R$). As a result, the protruding end surfaces 63, 73 of the protruding portions 62, 72 apply a (planar) external three dispersed at the surface portions of the protruding end surfaces 63, 73 to the sheath 30 (shield wire 1) and the opening end portion 21 of the folded braided conductor 20. As a result, the planar external three (that is, a holding force) can be applied to the sheath 30 (shield wire 1') and the opening end portion 21 of the folded braided conductor 20 at the surface portions of the groove bottom surfaces 53, 43 of the groove-shaped portions 52, 45, which have the damping shapes, of the clamping ring 50 and the shield terminal 40. As a result, a load on the sheath 30 (shield wire 1) and the opening end portion 21 of the folded braided conductor 20 can be reduced.

According to the method for producing the shield wire 1 according to the present embodiment, when clamping is performed by the upper die 60 and the lower die 70, the protruding portions 62, 72 of the mold surface press-deform the clamping ring 50 to the inner side in the radial direction. At this time, the radius of curvature R of the protruding end surfaces 63, 73 of the protruding portions 62, 72 is smaller than the radius R1 of the outer peripheral surface of the clamping ring 50 before clamping and is larger than the radius R2 of the outer peripheral surface of the sheath 30

(shield wire 1) before clamping. That is, a relationship of R2<R<R1 is established. As a result, the protruding end surfaces 63, 73 of the protruding portions 62, 72 exert a local (linear) external force on the clamping ring 50 at both end portions 63*a*, 73*a* of the protruding end surfaces 63, 73, and apply a (planar) external force dispersed at the surface portions of the protruding end surfaces 63, 73 on the sheath 30 (shield wire 1). Accordingly, the planar external force (that is, holding force) can be applied to the sheath 30 (shield wire 1) at the surface portions of the groove bottom surfaces 53, 43 of the groove-shaped portions 52, 45 having the clamping shapes while the clamping ring 50 and the cylindrical portion 41 of the shield terminal 40 are appropriately deformed into a clamping shape having the recessed groove-shaped portions 52, 45 corresponding to the protruding portions 62, 72 of the mold. Therefore, the production method according to the present embodiment can achieve both an increase in the holding force for fixing the shield terminal 40 to the braided conductor 20 and a reduction in the load on the sheath 30 (shield wire 1).

Further, according to the method for producing the shield wire 1 of the present embodiment, the radius of curvature R of the protruding end surfaces 63, 73 of the protruding portions 62, 72 is equal to or larger than the sum of the radius R3 of the outer peripheral surface of the cylindrical portion 41 of the shield terminal 40 before clamping and the thickness T of the braided conductor 20 (that is, the radius R3+T of the outer peripheral surface of the opening end portion 21 of the folded braided conductor 20 before clamping). That is, the relationship R3+T≤R is established. As a result, the protruding end surfaces 63, 73 of the protruding portions 62, 72 also apply a (planar) external force dispersed at the surface portions of the protruding end surfaces 63, 73 to the opening end portion 21 of the braided conductor 20 folded over the outer peripheral surface of the cylindrical portion 41 of the shield terminal 40. Therefore, the production method according to the present embodiment can reduce the load on the opening end portion 21 of the braided conductor 20 sandwiched between the cylindrical portion 41 of the shield terminal 40 and the clamping ring 50.

In addition, according to the shield wire 1 of the present embodiment, the shield terminal 40 and the clamping ring 50 have a cross-sectional shape having the groove-shaped portions 45, 52 recessed toward the axis thereof. As a result, the groove bottom surfaces 43, 53 of the groove-shaped portions 45, 52 apply a (planar) external force dispersed at the surface portions of the groove bottom surfaces 43, 53 to the sheath 30 (shield wire 1) and the opening end portion 21 of the braided conductor 20. As a result, the shield wire 1 according to the present embodiment has an excellent holding force for fixing the shield terminal 40 to the braided conductor 20, and a load generated in the sheath 30 (shield wire 1) and the braided conductor 20 is small, as compared with the shield wire produced by the device of related art.

According to the clamping device 2 of the present embodiment, when clamping is performed by the upper die 60 and the lower die 70, the protruding portions 62, 72 of the mold surface press-deform the clamping ring 50 to the inner side in the radial direction. At this time, since the protruding end surfaces 63, 73 of the protruding portions 62, 72 extend in the circumferential direction and the protruding side surfaces 64, 74 extend to the outer side in the radial direction from the both end portions 63*a*, 73*a* of the protruding end surfaces 63, 73, the protruding end surfaces 63, 73 of the protruding portions 62, 72 apply a local (linear) external force on the clamping ring 50 at the both end portions 63*a*, 73*a* of the protruding end surfaces 63, 73 and the like, and apply a (planar) external force dispersed at the surface portions of the protruding end surfaces 63, 73 on the sheath 30 (shield wire 1) and the braided conductor 20 (opening end portion 21). Accordingly, the planar external force (that is, holding force) can be applied to the sheath 30 (the shield wire 1) and the braided conductor 20 (the opening end portion 21) at the surface portion of the groove bottom surface 53 of the groove-shaped portion 52 having the clamping shape while the clamping ring 50 is appropriately deformed into a clamping shape having the recessed groove-shaped portion 52 corresponding to the protruding portions 62, 72 of the mold. Therefore, the clamping device 2 according to the present embodiment can achieve both an increase in the holding force for fixing the clamping ring 50 to the braided conductor 20 and a reduction in the load on the sheath 30 (shield wire 1) and the braided conductor 20.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

For example, in the above embodiment, the upper die 60 and the lower die 70 are provided with the protruding portions 62, 72, respectively. Alternatively, the "protruding portion" may be provided on only one of the upper die 60 and the lower die 70.

Further, in the above embodiment, the radius of curvature R of the protruding end surfaces 63, 73 of the protruding portions 62, 72 is larger than the radius R2 of the outer peripheral surface of the sheath 30 (shield wire 1) before clamping, and is equal to or larger than the sum of the radius R3 of the outer peripheral surface of the cylindrical portion 41 of the shield terminal 40 before clamping and the thickness T of the braided conductor 20 (that is, the radius R3+T of the outer peripheral surface of the opening end portion 21 of the folded braided conductor 20 before clamping). On the other hand, the radius of curvature R of the protruding end surfaces 63, 73 of the protruding portions 62, 72 may be larger than the radius R2 of the outer peripheral surface of the sheath 30 (shield wire 1) before clamping and smaller than the radius R3+T of the outer peripheral surface of the opening end portion 21 of the folded braided conductor 20 before clamping.

Further, in the above embodiment, the tubular braided conductor 20 is adopted as the "shield body". On the other hand, as the "shield body", for example, a tubular metal foil may be adopted as long as the tubular metal foil has electrical and electromagnetic characteristics capable of shielding electromagnetic waves. In addition, the "shield body" may be integrated with or separate from the covered wire 10.

According to the above embodiments, the method for producing the shield wire (1), the shield wire (1) having: a covered wire (10) configured to cover a conductor core wire (11) with a covering layer (12); a tubular shield body (20) disposed to cover the conductor core wire (11); and an earthing member (40, 50) clamped and fixed to the shield both (20), the earthing member having a tubular first terminal (40) and a tubular second terminal (50), and the production method comprising:

disposing the first terminal (40) at an opening end portion (21) of the shield body (20) in a state of the covered wire (10) and the shield body (20) being inserted into the first terminal (40);

folding the opening end portion (21) of the shield body (20) to an outer side in a radial direction and disposing the second terminal (50) to sandwich the folded opening end portion (21) between an outer peripheral surface of the first terminal (40) and an inner peripheral surface of the second terminal (50); and press-deforming the first terminal (40) and the second terminal (50) into a damping shape by sandwiching the first terminal (40) and the second terminal (50) with a mold (60, 70) in a direction intersecting an axis of the covered wire (10), a mold surface of the mold (60, 70) having a protruding portion (62, 72) protruding toward the axis, and a protruding end surface (63, 73) of the protruding portion (62, 72) having a radius of curvature smaller than a radius of an outer peripheral surface of the second terminal (50) before clamping and larger than a radius of an outer peripheral surface of the covered wire (10) before clamping.

According to the production method having the configuration described above, when the clamping is performed by the mold, the protruding portion of the mold surface press-deforms the tubular first terminal (for example, shield terminal) and the tubular second terminal (for example, clamping ring) to the inner side in the radial direction. At this time, the radius (R) of curvature of the protruding end surface of the protruding portion is smaller than the radius (R1) of the outer peripheral surface of the second terminal before clamping and is larger than the radius (R2) of the outer peripheral surface of the covered wire before clamping. That is, the relationship of R2<R<R1 is established. As a result, the protruding end surface of the protruding portion applies a local (that is, a point-like or linear) external force to the second terminal at both end portions of the protruding end surface, and applies a (planar) external force dispersed at the surface portion of the protruding end surface to the covered wire (and the shield body). Accordingly, the second terminal (and the first terminal) can be appropriately deformed into a clamping shape having a recessed groove-shaped portion corresponding to the protruding portion of the mold, and the second terminal (and the first terminal) can be clamped and fixed to the covered wire or the like in a state where the planar external force (that is, holding force) is sufficiently applied to a surface portion of the groove bottom surface of the groove-shaped portion. Therefore, the production method of the present configuration can achieve both an increase in the holding force for fixing the earthing member to the shield wire and a reduction in the load on the shield wire.

The "shield body" may have any electrical and electromagnetic characteristics capable of shielding electromagnetic waves, and the specific structure thereof is not particularly limited. For example, a braided conductor, a metal foil may be used as the shield body. Further, the shield body may be an integrated member (for example, a conductor core wire, a first covering layer, a shield body, and a second covering layer are laminated in this order) incorporated in the covered wire, or may be used as a separate member from the covered wire so as to cover the covered wire.

In the production method, the protruding end surface (63, 73) of the protruding portion (62, 72) may have a radius (R) of curvature equal to or greater than a sum (R3+T) of a radius (R3) of the outer peripheral surface of the first terminal (40) before clamping and a thickness (T) of the shield body (20) in a radial direction.

According to the production method of the above configuration, the radius (R) of curvature of the protruding end surface of the protruding portion is equal to or larger than the sum of the radius (R3) of the outer peripheral surface of the second terminal before clamping and the thickness (T) of the shield body. That is, the relationship R3+T≤R is established. As a result, the protruding end surface of the protruding portion also applies a (planar) external force dispersed at the surface portion of the protruding end surface to the shield body placed so as to be folded on the outer peripheral surface of the second terminal. Therefore, the production method of the present configuration can reduce the load on the shield body sandwiched between the first terminal and the second terminal.

According to the above programmable embodiments, the shield wire (1) with an earthing member, comprising:

a covered wire (10) configured to cover a conductor core wire (11) with a covering layer (12);

a tubular shield body (20) disposed to cover the conductor core wire (11); and an earthing member (40, 50) clamped and fixed to the shield body (20), wherein the earthing member includes a tubular first terminal (40) and a tubular second terminal (50).

the shield wire (1) has a clamping shape in a state of the covered wire (10) and the shield body (20) being inserted into the first terminal (40), an opening end portion (21) of the shield body (20) being folded toward an outer side in a radial direction, the folded opening end portion (21) being sandwiched between an outer peripheral surface of the first terminal (40) and an inner peripheral surface of the second terminal (50), and the first terminal (40) and the second terminal (50) being clamped to have a groove-shaped portion (45, 52) recessed toward an axis of the covered wire (10), and the groove-shaped portion (45, 52) having a groove bottom surface (43, 53) extending in a circumferential direction of the covered wire (10) and a groove side surface (44, 54) extending from both ends of the groove bottom surface (43, 53) in the circumferential direction to an outer side in a radial direction of the covered wire (10).

According to the shield wire having the above configuration, the First terminal and the second terminal have a clamping shape clamped so as to have a groove-shaped portion recessed toward the axis thereof. As a result, the groove bottom surface of the groove-shaped portion exerts a (planar) external force dispersed in the surface portion of the groove bottom surface on the covered wire (and the shield body). As a result, the shield wire having the present configuration is superior to the shield wire in which the earthing member is held and fixed by a hemispherical dent as described above in terms of the holding force for fixing the earthing member to the shield wire, and the burden on the shield wire is small.

According to the above exemplary embodiments, the clamping device (2) to clamp and fix a tubular clamping member (50) to an outer periphery of a predetermined object (1), the clamping device comprising:

a mold (60, 70) configured to press-deform the clamping member (50) by sandwiching the clamping member (50) in a direction intersecting an axis of the mold (60, 70), a mold surface of the mold (60, 70) having a protruding portion (62, 72) protruding toward the axis, and the protruding portion (62, 72) having a protruding end surface (63, 73) extending in a circumferential direction of the clamping member (50), and a protruding side surface (64, 74) extending to an outside of the clamping member (50) in a radial direction from both ends of the protruding end surface (63, 73) in the circumferential direction.

According to the clamping device having the above-described configuration, when the clamping is performed by the mold, the protruding portion of the mold surface press-deforms the clamping member to the inner side in the radial direction. At this time, the protruding end surface of the protruding portion extends in the circumferential direction of the clamping member, and the protruding side surface extends from both ends of the protruding end surface to the outer side of the clamping member in the radial direction. Therefore, the protruding end surface of the protruding portion applies a local (point-like or linear) external force to the clamping member at both end portions of the protruding end surface, and applies a (planar) external force dispersed at the surface portion of the protruding end surface to the object to be clamped. Accordingly, the clamping member can be appropriately deformed into a clamping shape having a recessed groove-shaped portion corresponding to the protruding portion of the mold, and a planar external force (that is, a holding force) can be applied to the object by the surface portion of the groove bottom surface of the groove-shaped portion. Therefore, the clamping device having the present configuration can achieve both an increase in the holding force for fixing the clamping member to the object and a reduction in the load on the object.

According to the present invention, it is possible to provide a method for producing a shield wire, a shield wire with an earthing member, and a clamping device that can achieve both an increase in holding force for fixing the earthing member to the shield wire and a reduction in load on the shield wire.

What is claimed:

1. A method for producing a shield wire, the shield wire having: a covered wire configured to cover a conductor core wire with a covering layer; a tubular shield body disposed to cover the conductor core wire; and an earthing member clamped and fixed to the shield body, the earthing member having a tubular first terminal and a tubular second terminal, the method comprising:

disposing the first terminal at an opening end portion of the shield body in a state of the covered wire and the shield body being inserted into the first terminal;

folding the opening end portion of the shield body to an outer side in a radial direction and disposing the second terminal to sandwich the folded opening end portion between an outer peripheral surface of the first terminal and an inner peripheral surface of the second terminal; and press-deforming the first terminal and the second terminal into a clamping shape by sandwiching the first terminal and the second terminal with a mold in a direction intersecting an axis of the covered wire, a mold surface of the mold having a protruding portion protruding toward the axis, and a protruding end surface of the protruding portion having a radius of curvature smaller than a radius of an outer peripheral surface of the second terminal before clamping and larger than a radius of an outer peripheral surface of the covered wire before clamping.

2. The production method according to claim 1, wherein the protruding end surface of the protruding portion has a radius of curvature equal to or greater than a sum of a radius of the outer peripheral surface of the first terminal before clamping and a thickness of the shield body in a radial direction.

* * * * *